United States Patent [19]

Alston

[11] 4,296,925

[45] Oct. 27, 1981

[54] JUMP TRAINER

[76] Inventor: William G. Alston, 151-A Treetop Dr., Fayetteville, N.C. 28301

[21] Appl. No.: 161,746

[22] Filed: Jun. 23, 1980

[51] Int. Cl.[3] ..... A63B 5/16; A63B 69/00

[52] U.S. Cl. ..... 273/1.5 A; 273/411; 273/413

[58] Field of Search ..... 273/1.5 R, 1.5 A, 411, 273/58 C, 413, 414; 272/101

[56] References Cited

U.S. PATENT DOCUMENTS

| | | | |
|---|---|---|---|
| 2,186,016 | 1/1940 | Evans | 273/58 C X |
| 2,570,860 | 10/1951 | Redding | 273/1.5 A X |
| 2,697,603 | 12/1954 | Haines | 273/1.5 A |
| 3,023,001 | 2/1962 | Gourdouze | 273/1.5 A |
| 3,288,466 | 11/1966 | Cumings | 273/1.5 A |
| 3,602,504 | 8/1971 | Chapman et al. | 273/411 X |
| 3,717,342 | 2/1973 | Haney et al. | 273/1.5 A |
| 3,790,171 | 2/1974 | Anderson | 273/413 |
| 3,804,409 | 4/1974 | Schachner | 273/58 C X |
| 3,897,950 | 8/1975 | Keller | 273/411 |
| 4,161,313 | 7/1979 | Dickey | 273/1.5 A |

FOREIGN PATENT DOCUMENTS

| | | | |
|---|---|---|---|
| 133090 | 6/1949 | Australia | 273/1.5 A |
| 6413102 | 5/1966 | Netherlands | 273/1.5 R |

*Primary Examiner*—Paul E. Shapiro
*Attorney, Agent, or Firm*—Mills & Coats

[57] ABSTRACT

This invention is a device for jump training of sport participants and features a double beat board mounted at converging angles from vertical to give a smooth, effective repeating bounce to a tethered ball. The beat board as well as the ball can be vertically adjusted and the tether of the ball can be extended against a suspended weight system. The entire trainer is compact, simple to operate, and effective for its intended purpose.

12 Claims, 3 Drawing Figures

JUMP TRAINER

FIELD OF INVENTION

This invention relates to athletic equipment and more particularly to jump training devices.

BACKGROUND OF INVENTION

In the past various types of training and exercise devices have been developed for various sports. In the areas of volleyball and basketball, jump training devices have been used which are height adjustable, will absorb shock and are portable so they can be moved from place to place. Additionally, devices for practicing rebounding, particularly of the basketball type, have been developed, patented and sold commercially. None of these devices, however, have been specifically designed nor capable of creating rhythm in the agility of the participant but have simply provided for standard jump and grab type practice. Skill in eye and hand coordination has had to come from actual play of the sports involved. This, of course, requires the participation of a plurality of people which prevents the enthusiastic athlete from practicing longer than the overall group. Even during play, the majority of the players are watching rather than participating which means that even during game type practice, very little actual practice is accomplished by any given player during the traning period.

BRIEF DESCRIPTION OF INVENTION

After much research and study into the above-mentioned problems, the present invention has been developed to provide a means for drill training sport participants in a concentrated manner. This is accomplished through use of a pair of beat boards angled inwardly from vertical at approximately fifteen degrees with the participant being able to set up and maintain a bouncing rhythm in a jumping condition similar to the rhythm established by a boxer using a speed bag. The present invention can be used for both rebound drilling and hand-timing drills in basketball as well as alternate hand-spike drills and same hand-spike drills in volleyball.

In view of the above, it is an object of the present invention to provide a jump trainer with dual beat boards angled inwardly from vertical toward each other.

Another object of the present invention is to provide an improved jump trainer having a tethered ball disposed between dual, angularly disposed beat boards.

Another object of the present invention is to provide an athletic training device which is portable and height adjustable.

Another object of the present invention is to provide an improved jump trainer with a weighted ball control means.

Another object of the present invention is to provide a detachable swivel attachment in a jump training device to allow balls to be readily interchanged.

Another object of the present invention is to provide a jump training means having dual, oppositely facing beat boards with a ball suspended approximately twelve inches therebelow.

Another object of the present invention is to provide a means for enhancing the vertical jumping power and altitude of an athlete.

Another object of the present invention is to provide a means for enhancing vertical jumping timing.

Another object of the present invention is to provide a means for enhancing eye-hand coordination specific to basketball and volleyball.

Another object of the present invention is to provide a means for enhancing total body coordination timing.

Another object of the present invention is to provide a means for enhancing ball control and hand strength specific to the rebounding skill in basketball.

Another object of the present invention is to provide a means for enhancing power, form, and timing specific to the spiking skill in volleyball.

Another object of the present invention is to provide a means for enhancing cardiovascular endurance through repeated purposeful leaping and jumping.

Another object of the present invention is to provide a means for enhancing muscular endurance and muscle and joint strength and durability through repeated purposeful leaping and jumping.

Other objects and advantages of the present invention will become apparent and obvious from a study of the following description and the accompanying drawings which are merely illustrative of such invention.

DETAILED DESCRIPTION OF INVENTION

Figure 1:
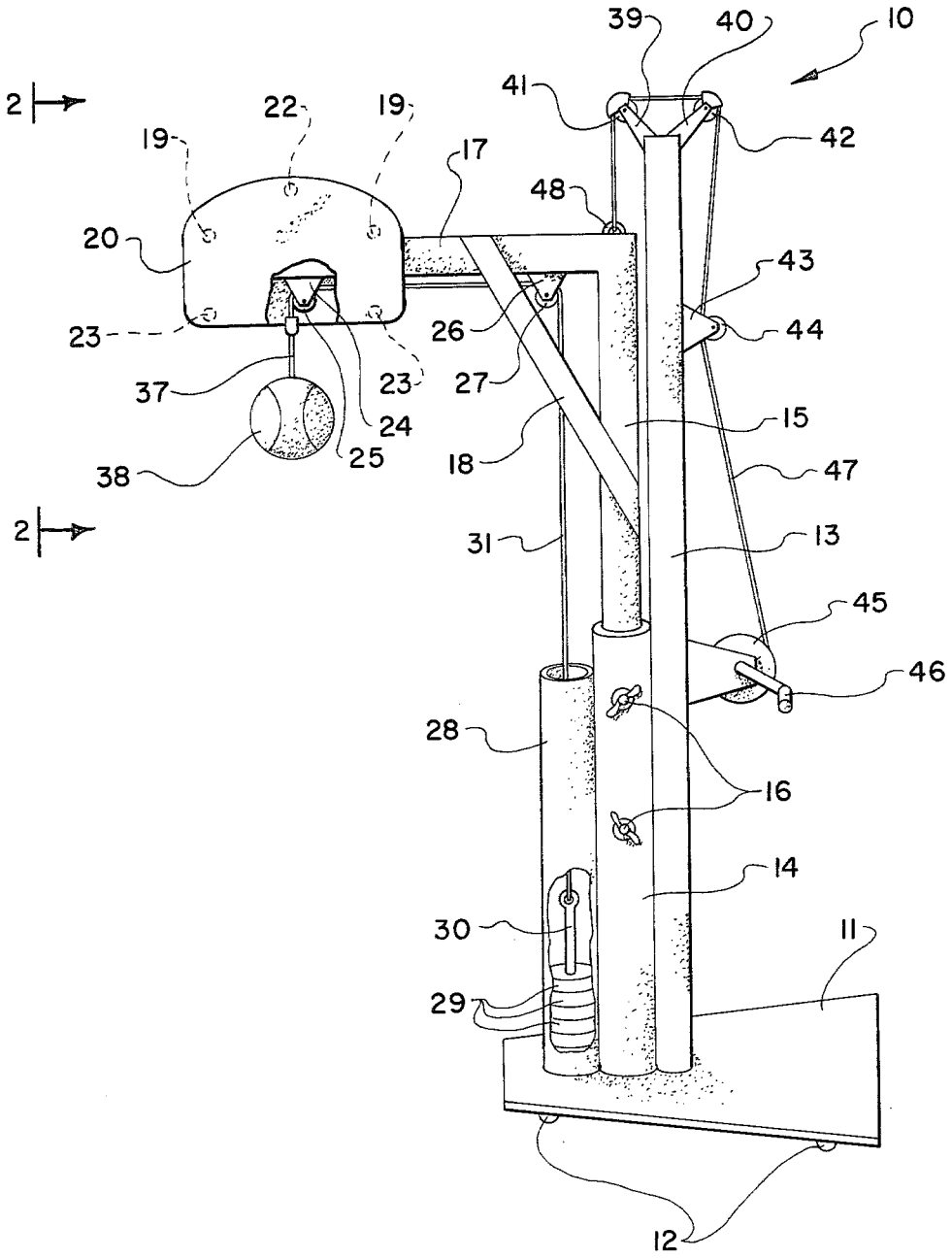
FIG. 1 is a perspective view of the jump trainer of the present invention.

With further reference to the drawings, the jump training device of the present invention, indicated generally at 10, has a base portion 11 constructed of steel or other suitable material. Wheels 12, preferably of a caster type, are provided on the bottom of base 11. Since details of caster wheels are well known to those skilled in the art, further detailed discussion of the same is not deemed necessary.

An elongated, generally vertically disposed stanchion 13 is fixedly secured at one end to base 11. This stanchion is preferably constructed of steel pipe or other suitable material.

Lying juxtaposed to the lower portion of stanchion 13 is a guide tube 14. This tube can be fixedly secured to both stanchion 13 and base 11 by weldment or other suitable means.

Vertical beat board support member 15 is telescopically mounted within guide tube 14. A plurality of set screws 15 are provided to releasably lock support member 15 relative to guide tube 14.

A generally horizontally disposed beat board support arm 17 is fixedly secured at one end to the top of vertical support member 15. A brace 18 is provided which is fixedly secured at opposite ends between support member 15 and support arm 17 to prevent any bending movement between said parts.

Figure 2:
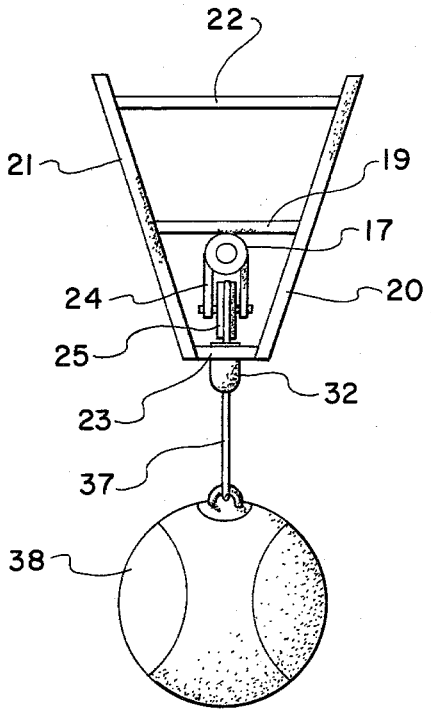
FIG. 2 is an end elevational view of the beat board portion of the trainer of the present invention.
Figure 3:
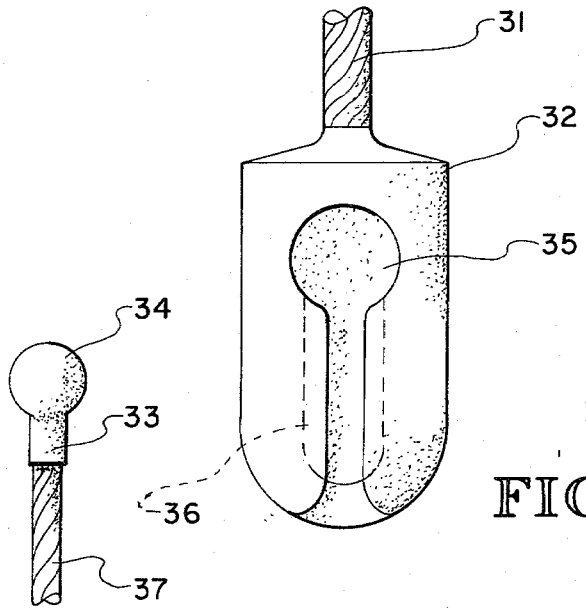
FIG. 3 is an enlarged view of the ball swivel connector of the training device of the present invention.

A plurality of horizontal support brackets 19 are secured to the outer end of horizontal support arm 17 by weldment or other suitable manner. A pair of matching beat boards 20 and 21 are secured one to each end of the support brackets 19. Upper and lower braces 22 and 23 are secured to and extend between the beat boards 20 and 21 as can be seen particularly clear in FIG. 2.

Sheaves 24 are fixedly secured to the lower portion of support arm 17 and rotatively mount pulley 25. The outer edge of this pulley is in line with the vertical center of beat boards 20 and 21 as can be seen in FIG. 1. The reason for this alignment is of course to allow suspension of a ball centered directly beneath the beat boards as will hereinafter be described in greater detail.

A second sheave 26 is secured to arm 17 adjacent its juncture with support member 15. This sheave rotatively mounts pulley 27 in the normal manner and the edge opposite pulley 25 is vertically aligned with the longitudinal axis of weight tube 28. This weight tube, which is open at its upper end, is generally vertically disposed on base 11 and juxtaposed to guide tube 14. Weldment or other suitable means is used to fix the relationship between weight tube 28 and guide tube 14.

Removable weight plates 29 are provided on weight shaft 30. Since removable/addable weights of this type are well known to those skilled in the art, further detailed discussion of the same is not deemed necessary.

The weights 29 are disposed within weight tube 28 as seen in FIG. 1 and can move vertically up and down therein. A cable means 31 is secured to the upper end of weight shaft 30, is trained over pulley wheels 27 and 25 and terminates at a female swivel connector 32.

A male swivel connector 33 terminating in a ball-like bulbous portion 34 is adapted to slide into opening 35 of the female swivel connector 32 with the ball portion 30 being retained in the interior cavity 36 of said connector portion 32.

From the above, it can be seen that once the male connector has been passed through opening 35 of the female connector and the ball portion 34 of such male connector appropriately seated in cavity 36, a connection is provided which can readily be connected and disconnected and yet will not become accidentally disconnected during use. It also gives a swivel connection which reduces wear on the suspending cables.

A cable or other suitable tether means 37 is fixedly secured to connector 33 at one end and to ball 38 at its other end.

The at-rest suspended distance from the bottom of the beat boards 20 and 21 to the center of ball 38 should be approximately twelve inches.

Pairs of sheaves 39 and 40 are provided on opposite sides of the upper portion of stanchion 13 and rotatively mount pulley wheels 41 and 42, respectively. Sheaves 43 are fixedly secured to the side of stanchion 13 and rotatively mount guide pulley 44. Below this guide pulley and also fixedly mounted on the side of stanchion 13 is a winch mechanism 45 operated by a handle 46. Since mechanisms of this type are well known to those skilled in the art, further detailed discussion of the operation of the same is not deemed necessary.

A cable 47 is windingly connected to winch 45, is trained about pulleys 44, 42 and 41, and is connected at its opposite end to cable connector tab 48 secured to the upper portion of support member 15 as can clearly be seen in FIG. 1.

Whenever it is desired to adjust the height of beat boards 20 and 21, set screws 16 are loosened and winch mechanism 45, through handle 46, is manipulated to raise or lower vertical support member 15 within guide tube 14. When the desired height has been reached, set screws 16 are tightened to rigidly hold the adjustment made.

Depending on the type of practice to be conducted, the appropriate amount of weights are added or subtracted from mounting shaft 30 to give the ball 38 the appropriate bias through its connection to such weights by cable 31.

Once the height and weight adjustments have been made, then the device is ready for use.

The device of the present invention is designed to enhance the vertical jumping skills and abilities of the user thereof. It is particularly useful in enhancing vertical jumping power and altitude as well as jumping timing. It also increases the eye-hand coordination specific to both basketball and volleyball as well as total body coordination and timing. Ball control and hand strength specific to rebounding skills in basketball are enhanced as well as power, form and timing specific to the spiking skills of volleyball. Cardiovascular endurance is increased through repeated, purposeful leaping and jumping as is muscular endurance, muscle and joint strength and general durability.

The present invention can be used in a similar manner to boxers using a speed bag to increase skills in timing and eye-hand coordination except the drills are specifically designed for basketball and volleyball players by simulating specific game movements.

The following are examples of some of the types of drills which can be conducted using the jump trainer:

EXAMPLE 1—Basketball

A tethered basketball is set at a height so that the ball is approximately three inches lower than the player can reach with his best vertical jump. As mentioned earlier, the center of the ball itself is suspended approximately twelve inches below the bottom of the beat boards.

1. Rebound Drill

The ball is rebounded repeatedly by grasping it with both hands and bringing it down to the correct position with control and releasing it and rebounding again. The constant resistance of the weights 29 will, of course, force the player to maintain firm control throughout the rebound movement and not just at the top. Also the ball can be made to swing thereby forcing the player to time his jumps and maintain eye contact with the ball.

2. Alternate hand drills (a) Two beat drill—the user will jump up and contact the ball with his right hand and throw (not slap) the ball so that it bounces once on each side of the beat board. The next jump must be timed so that he catches the ball coming off its second bounce and, switching to the left hand and facing in the opposite direction, throw the ball with enough force and control to make it bounce twice and only twice before he goes up and once more throws with his right hand. This sequence can be repeated as long as desired.

(b) Three-beat drill—the participant jumps up and contacts the ball with his right hand and throws (not slaps) the ball so that it completes a three bounce cycle (front, back and front). As the ball comes off of the front of the board the third time the player or participant goes up again and prepares to repeat the sequence using his left hand. This drill, of course, is simpler than the two-beat drill because the player does not have to change his body position and direction and because the three-beat cycle allows more time between jumps. It is believed that the two above-described drills are superior to any jumping drills currently in use because (1) they provide the player with a challenge and incentive to correctly execute the beats; (2) the player competes with other players to see who can keep the rhythm going longest or can complete the greatest number of plays in a given time; (3) the skill involved is a complete skill which is specific and game-like; and (4) the drill teaches the players to use both their dominant and nondominant hands in controlling the ball.

EXAMPLE 2—Volleyball

A tethered volleyball is used and set at a height so that the ball is approximately four inches lower than the player can reach with his best vertical jump. The ball is, of course, again suspended with its center twelve inches below the beat boards.

1. Alternate hand, four bounce, spike drill

The player jumps up, spikes the ball with his right hand and then on every fourth bounce off the beat boards thereafter with alternate hands. In order to perform this drill successfully, the player must achieve a near maximum jump and execute solid, well timed and well directioned spikes. In order to get the four bounces necessary to maintain the rhythm, the player must strike the ball slightly above center in a slightly downward direction with good power and follow through. In other words, the most effective spike on the jump trainer is identical to the most effective spike in an actual game. The player following each spike must reset his body position, face in the opposite direction, visually follow the ball, time the next jump, and switch to the opposite hand all in a fluid series of movements to properly execute the drill.

2. Same hand, four bounce spike drill

This drill is identical to drill 1 except each spike is made with the same hand. After each spike the player must adjust his position quickly and prepare to take the ball from the opposite direction using the same hand.

3. Alternate hand, five bounce, spike drill

This drill requires greater power but less body adjustment between jumps. The player must face the same direction but switches hands on each spike. The coach can time this drill to see how many spikes the player can make in a set amount of time (usually one to three minutes). The harder and more effective the spikes, the faster the rhythm.

4. Same hand, five bounce, spike drill

This drill is the same as drill 3 except the player hits continually with the same hand throughout the sequence.

5. Three bounce, spike drill

By switching to a three bounce rhythm off the beat boards, the player spikes the ball as many times as possible in a preset time span. Either alternate hand or the same hand method can be used. This is a high speed drill which can be maintained for only a few minutes.

From the above it can be seen that the present invention is relatively uncomplicated to adjust and yet is highly efficient in use. The various drills which can be accomplished thereon are unique in the training field and allow game type situations to be simulated. By quickly changing the ball at the swivel joint, the present invention can be converted from basketball to volleyball and vice versa with a minimum of time and effort being involved.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A jump training device comprising: a pair of beat boards disposed back to back; means for supporting said beat boards a predetermined distance from a playing surface; and a game type ball suspended adjacent to and below said beat boards whereby an improved jump training device is provided.

2. The training device of claim 1 wherein the beat boards are disposed in a generally vertical position.

3. The training device of claim 2 wherein said beat boards are inclined slightly toward each other from top to bottom whereby better beat action can be accomplished.

4. The training device of claim 3 wherein said boards are inclined at an angle of approximately fifteen degrees from vertical.

5. The training device of claim 1 wherein said means for supporting said beat boards is a stanchion type means.

6. The training device of claim 5 wherein said support means is portable.

7. The training device of claim 5 wherein the stanchion is vertically adjustable.

8. The training means of claim 7 wherein said ajusting means is a winch and cable type device.

9. The training device of claim 1 wherein said suspended ball is counterbiased.

10. The training device of claim 9 wherein said counterbiasing means is a weight means.

11. The training device of claim 10 wherein said ball is of the basketball type.

12. The training device of claim 1 wherein the ball is of the volleyball type.

* * * * *